US005853167A

United States Patent [19]

West et al.

[11] Patent Number: 5,853,167

[45] Date of Patent: Dec. 29, 1998

[54] DECORATIVE COVER FOR POSTS

[75] Inventors: Ron West, Provo, Utah; John Forbis, York, Nebr.

[73] Assignee: Kroy Building Products, Inc., York, Nebr.

[21] Appl. No.: 808,980

[22] Filed: Feb. 19, 1997

[51] Int. Cl.[6] ..... E04H 17/14

[52] U.S. Cl. ..... 256/66; 256/19; 256/50; 256/59; 256/DIG. 5; 5/301

[58] Field of Search ..... 256/1, 19, 22, 256/50, 59, 66, DIG. 5; 52/301; 403/289, 290

[56] References Cited

U.S. PATENT DOCUMENTS

| | | | |
|---|---|---|---|
| 4,050,828 | 9/1977 | Noro | 256/22 X |
| 4,378,175 | 3/1983 | Hasselqvist et al. | 256/1 X |
| 4,722,514 | 2/1988 | Pettit | 256/19 |
| 4,805,879 | 2/1989 | Spera | 256/22 X |
| 5,255,897 | 10/1993 | Pepper | 256/59 X |
| 5,299,883 | 4/1994 | Arth, Jr. | 52/301 X |
| 5,419,536 | 5/1995 | Bender | 256/1 |
| 5,421,556 | 6/1995 | Dodge et al. | 256/1 |
| 5,441,239 | 8/1995 | Watson | 256/1 |
| 5,469,679 | 11/1995 | Burkard et al. | 52/301 |
| 5,645,270 | 7/1997 | Lawrence | 256/19 X |
| 5,651,533 | 7/1997 | Ling | 256/1 X |
| 5,660,376 | 8/1997 | West | 256/1 X |

*Primary Examiner*—Blair M. Johnson
*Assistant Examiner*—Bruce A. Lev
*Attorney, Agent, or Firm*—Thorpe, North, & Western, L.L.P.

[57] ABSTRACT

A decorative cover for posts includes a collar portion which is configured to cover attachment devices and the like to provide a more aesthetically pleasing termination for the post. A cap portion can be provided which engages the collar to cover the end of the post. Preferably, the collar and cap portion can both be attached to the post without the use of tools.

18 Claims, 6 Drawing Sheets

DECORATIVE COVER FOR POSTS

BACKGROUND OF THE INVENTION

1. Field of the Invention

The present invention relates to a decorative cover for a post to cover the post without exposed attachment marks. More particularly, the present invention relates to a cover formed by a cap portion and a collar portion which are configured to snap together to thereby provide an improved cover for a post, and which may also be used independently of one another to provide a finished look to support posts and the like.

2. State of the Art

There are numerous types of fences and railings which are used to designate boundaries. Fences may be used on property lines, or to protect individuals from dangerous locations. Additionally, railings on stair cases and decks help to steady people and prevent accidental injury.

Recently, there has been a tremendous increase in the use of vinyl and other composite fencing products. The vinyl and other composites are durable and resistance to denting. Additionally, the vinyl retains its color and need not be stained or otherwise treated every year to prevent decay.

In fences and railings made from vinyl, there are typically spaced apart hollow support posts which are larger and stronger than rails or other intermittent structures which which complete the fence, etc. The support posts are generally disposed vertically and have an upper termination adjacent to or above the intermittent structures. Thus, it is usually desirable to cover the hollow support posts to prevent rain and debris from filling the hollow portion, and to prevent injury should a person forcefully impact the top of the post. Additionally, the cover will usually provide a more aesthetically pleasing look than an open post.

The covers which are currently used on support posts and the like generally have a gradual tetrahedral or an oblate design. As shown in FIG. 1, the cap 10 sits on top of the post 14. The cap 10 cover the opening 18 and typically has an outer wall 22 which extends about the end of the post. A bolt or screw 26 is typically used to attach the outer wall 22 to the post 14.

While the configuration shown in FIG. 1 is functional, it has several draw backs. A major draw back is that the design does not provide the look of a high quality finished product because of the simplicity of the design. While the design is acceptable, considerable improvements could be made to the cover, both to minimize the risk of injury, and to improve the aesthetics associated therewith. A second major disadvantage is that the screw 26 or other attachment device is often visible and provides a less finished look. While the screw 26 could be painted, it is generally still noticeable.

Thus, there is a need for an improved cover for support posts and the like. Preferably, the cover will be inexpensive to manufacture, easy to install and provide an aesthetically pleasing design. Additionally, the cover design should be adaptable to different sizes of support posts, and may be configured so that a single sized cover can be used on more than one size of post. Furthermore, such a cover should enable trim to be added around other support posts in such manner as to maintain a common look.

OBJECTS AND SUMMARY OF THE INVENTION

Thus, it is an object of the present invention to provide an improved decorative cover for posts which provides an improved fit and more aesthetically pleasing design than covers currently in use.

It is another object of the present invention to provide such a cover which has a cap portion and a collar portion, with the collar portion being attachable to the support post, and the cap portion being attachable to the collar portion.

It is yet another object of the present invention to provide such a cover wherein the cap portion and the collar portion can be used independently of each other to provide finish pieces for other support posts and other structures while maintaining a common design scheme.

The above and other objects of the invention are realized in specific illustrated embodiments of a cover for posts and the like, the cover including a cap portion and a collar portion. The collar portion has an outer sidewall which is generally continuous, and an inner wall which is configured to define a void. Unlike the outer wall, the inner wall will generally not be continuous. Rather, it will be broken up adjacent the top thereof to form a plurality of trim catches or legs, the purpose for which is discussed in detain below.

The void defined by the inner wall is configured to receive the end of a support post. One or more tabs extend inwardly from the trim catches/legs so as to rest on the top of a support post disposed in the void, thereby supporting the collar portion as the outer wall of the collar portion circumscribes the end of the support post.

The cap portion of the cover is designed to engage the collar portion in a snap-on or other toolless attachment, thereby securing the cap portion to the collar portion and providing a complete cover for the support post. The cap portion typically includes an upper wall which extends outwardly a sufficient distance to engage the upper end of the outer wall of the collar portion, so that the outer wall of the collar portion and the upper wall of the cap portion form a generally continuous cover over the open top end of the support post.

In accordance with one aspect of the invention, the cap portion has one or more flanges which extend downwardly from the upper wall so that the flange will be disposed at least partially in the open top of the support post when the support post is disposed in the void formed by the collar portion. Preferably, each of the flanges has an opening formed therein to enable the tabs of the collar portion to extend at least partially through the flanges, and thereby enable the cap portion to snap onto a locked engagement with the collar portion. The engagement between the collar portion and the cap portion, in turn, secures the cap portion to the post.

When the cap portion and the collar portion are attached to one another and disposed on the top of the support post, the two portions provide a cover which is safer and more aesthetically pleasing than the simplistic designs of the prior art. The cover also provides a professional, finished look that even can be achieved by amateurs.

In addition to the use of the collar portion and the cap portion together to form a cover, the two portions of the cover can also be used independent of each other to provide a more consistent appearance and to improve the look of other portions of support posts, etc. For example, the upper wall of the cap portion can be configured to engage a larger sized support post. Thus, if the cap portion is typically used with a support post which is 3 inches wide, opposing ends of the cap portion may be 5 inches apart, thereby enabling the cap portion to serve a more conventional cap on a support post which is 5 inches wide. Because the cap portion would have the same slope and other design features of the cap portions used with the smaller posts, more consistent design would be achieved even though the collar portion is not used.

Likewise, the collar portion can be used without modification on other types of support posts. For example, it is now common to use vinyl support posts in the place of balusters at the front of a porch with an overhang. The bottom of the support post is attached to the deck, and the top of the support post is attached to the bottom of the roof. Unfortunately, the screws and brackets which are typically used to secure the support post to the deck and to the roof are often unsightly. However, positioning the collar portion about the top and bottom of the support post provides a nice finishing trim and covers the screws and brackets.

BRIEF DESCRIPTION OF THE DRAWINGS

The above and other objects, features and advantages of the invention will become apparent from a consideration of the following detailed description presented in connection with the accompanying drawings in which.

DETAILED DESCRIPTION

Reference will now be made to the drawings in which the various elements of the present invention will be given numeral designations and in which the invention will be discussed so as to enable one skilled in the art to make and use the invention. It is to be understood that the following description is only exemplary of the principles of the present invention, and should not be viewed as narrowing the pending claims.

Figure 1:
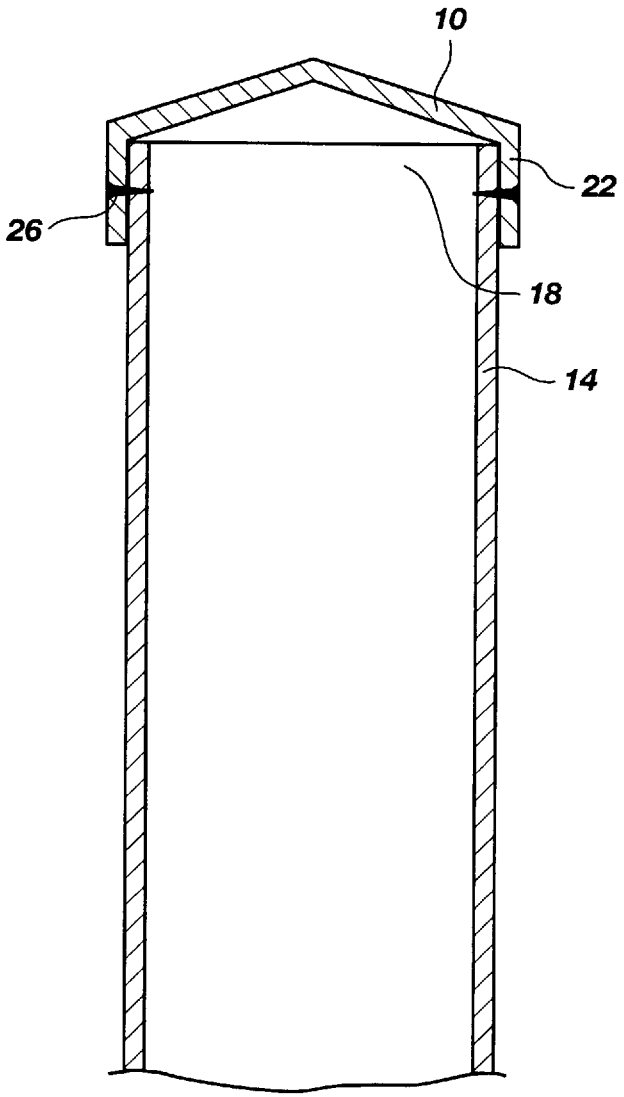
Fig. 1 (PRIOR ART)
FIG. 1 shows a side cross-sectional view of a support post and a cap made in accordance with the principles of the prior art.
Figure 2:
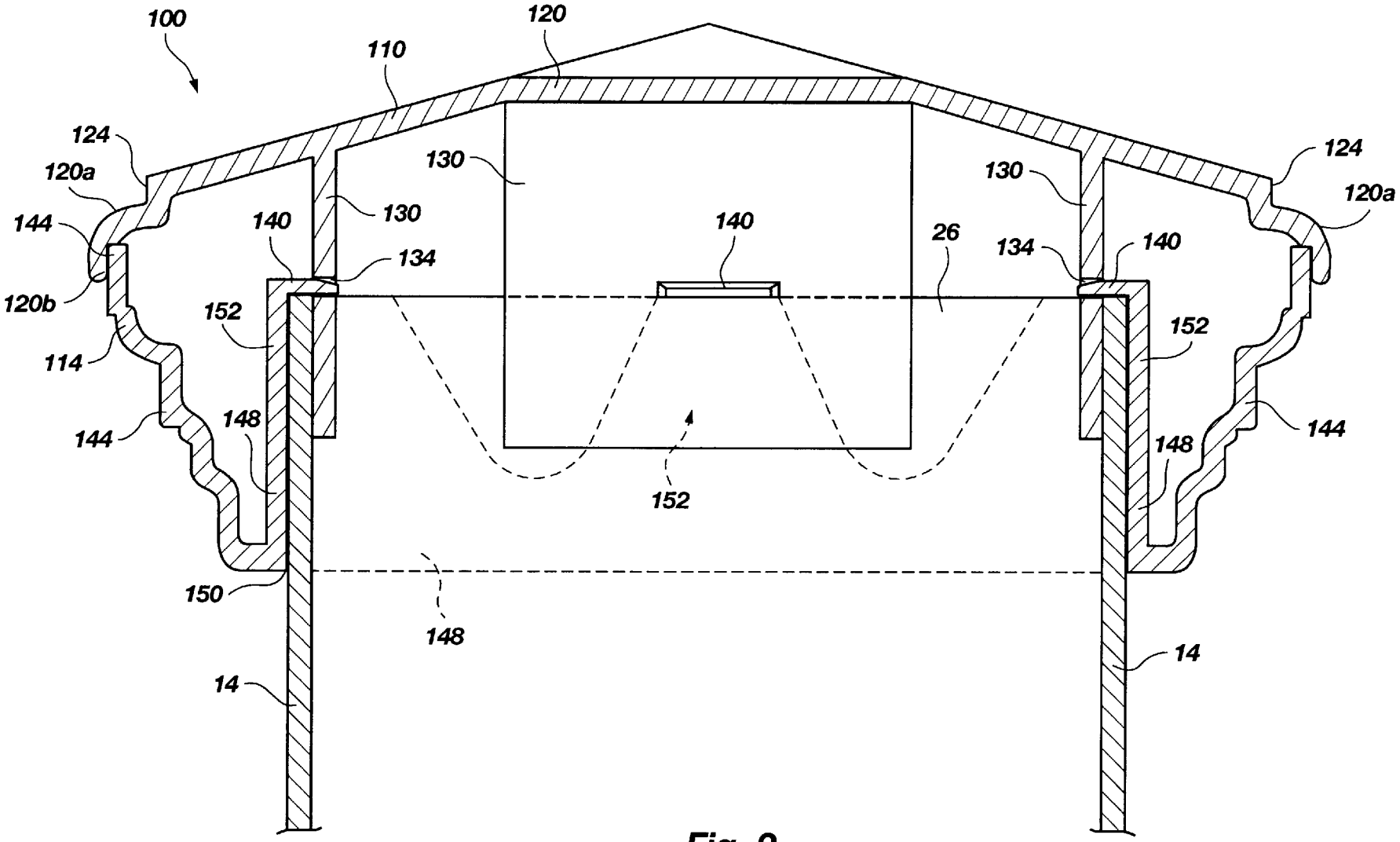
FIG. 2 shows a side cross-sectional view of a conventional support post having a cover disposed thereon in accordance with the present invention, the cover including a collar portion and a cap portion.

Referring to FIG. 2, there is shown a side cross-sectional view of a decorative cover, generally indicated at 100, made in accordance with the principles of the invention. The cover 100 is mounted on a conventional post 14. The cover 14 is formed from a cap portion 110 and a collar portion 114.

The cap portion 110 includes a large upper wall 120 which configured to prevent water and debris from entering the opening 22 in the top of the support post 14 when the cap portion is positioned thereover. A scalloped groove 124 or some other decorative design is formed in the upper wall 120 about its perimeter 120*a* to add to the decorative nature of the cover 100. A groove 120*b* may also be formed to enable nesting of the collar portion 114 into the cap portion 110.

Extending downwardly from the upper wall 120 are a plurality of flanges 130, only three of which are shown in FIG. 2. The flanges 130 are disposed so as to nest snugly within the opening 18 in the top of the post 14, to thereby prevent undesired lateral movement of the cap portion 110 of the cover 100. Disposed at an intermediate position on the flanges 130 are receiving channels 134, as will be discussed in detail with respect to FIG. 2A, the receiving channels 134 are disposed to receive catch tabs 140 which form part of the collar portion 114 of the cover.

Turning now to the collar portion 114, the collar portion is formed from an outer wall 144 which has a decorative pattern, such as various grooves, molded therein, and an inner wall 148. The inner wall 148 defines a void 150 into which the top of the support post 14 nests when the cover 100 is disposed thereon. To maintain the top of the post 14 in the void 150, a plurality of trim catches or legs 152 are attached to the inner wall and extend upwardly so that each of the catches is disposed adjacent the post 14, and on side opposite the flanges 130. A catch tab 140 extends inwardly from the top of each leg 152 so that the collar portion 114 is supported by the catch tabs. Preferably, the catch tabs 140 extend sufficiently far to engage the channels 134 in the flanges 130.

When the collar portion 114 is disposed on the top of the post 14, the cap portion 110 can be attached thereto without the use of tools. The cap portion 110 is disposed so that the flanges 130 will nest within the opening 18 in the post. As the cap portion 110 is pushed downwardly, the legs 152 and the catch tabs 140 are forced outward slightly. Once the flanges 130 are sufficiently nested within the opening 18 that the channels 134 are in alignment with the catch tabs 140, the catch tabs are forced into the channels and thereby inhibit movement of the cap portion 110 in either direction.

With the catch tabs 140 nested in the channels 134, the upper end 144*a* of the outer wall 144 engages the groove 120*b* in the perimeter 120*a* of the upper wall 120, thereby forming a generally continuous decorative cover 100 over the top of the post 14.

Those skilled in the art will appreciate that numerous retention mechanisms could be used to hold the cover 100 on top of the post 14. For example either the flanges 130 of the cap portion 110 or the inner wall 148 of the collar portion could be coated with an adhesive. Once either of these structures is bonded to the post, the remaining structures of the cover 100 are also attached thereto.

Figure 2A:
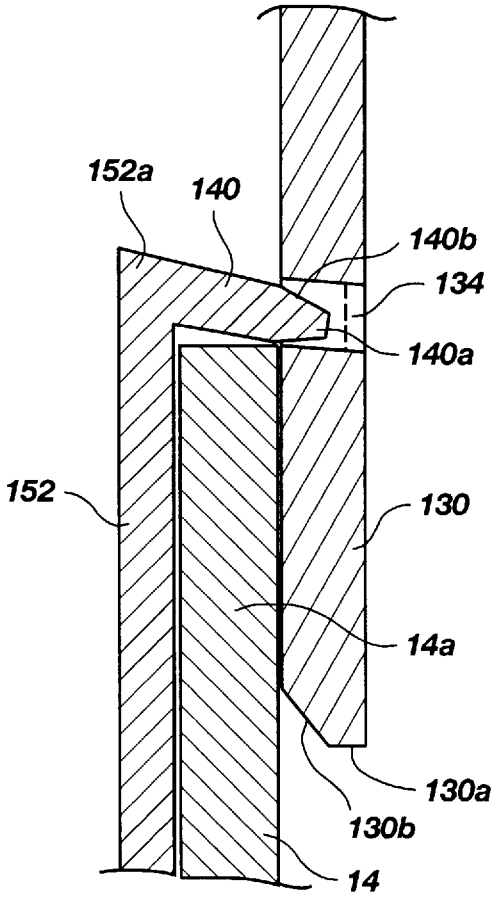
FIG. 2A shows a close-up view of the snap-on engagement which secures the collar portion to the cap portion on the support post.

Turning now to FIG. 2A, there is shown a close-up view of the engagement between the catch tab 140 of the collar portion 114, and the flange 130 of the cap portion 110. The leg 152 preferably extends upwardly to a position slightly above the wall 14*a* of the post 14. The catch tab 140 extends inwardly from the upper end 152*a* of the leg 152, and preferably extends downwardly at an angle of about 5 degrees. The downward slope of the catch tab 140 helps the catch tab to engage the channel 134 in the flange 130. As shown in FIG. 2A, the channel 134 can extend into or through the flange 130. Regardless of which is used, the channel 134 should be properly configured to receive the catch tab 140.

In addition to securing engagement of the flange 130, the downward slope of the catch tab 140 also assists in the initial placement of the flange. The lower end 130*a* of the flange 130 has a beveled edge 130*b* disposed on the outside portion thereof. Likewise, inner end 140*a* of the catch tab 140 has a beveled portion 140*b*. When the cap portion 110 is pushed downwardly so that the flanges 130 nest in the post 14, the beveled edge 130*b* of the flange 130 engages the beveled portion 140*b* of the catch tab 140. The two slide with respect to one another and help to temporarily deflect the catch tab 140 out of the way. Once the channel 134 is disposed in alignment with the inner end 140*a* of the catch tab 140, the catch tab returns to its original position and locks the flange 130 in place.

Figure 3:
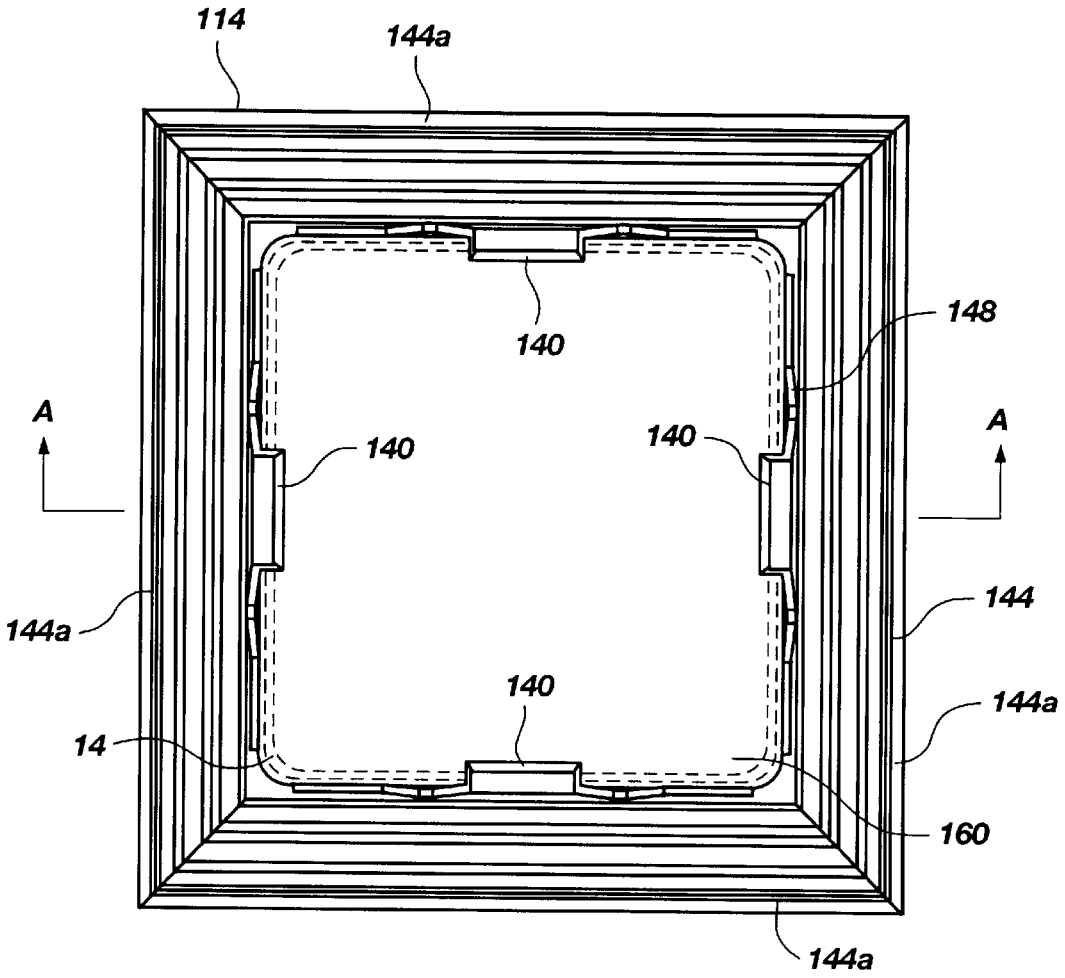
FIG. 3 shows a top view of the collar portion shown in FIG. 2.

Referring now to FIG. 3, there is shown a top view of the collar portion 114 shown in FIG. 2. The collar portion 114 is formed by the outer wall 144 and inner wall 148. The outer wall 144 is formed by four joined sidewalls 144*b* which extend upwardly and outwardly. The inner wall 148, in contrast, is disposed generally vertically and defines a void 160 for receiving the top of the post, indicated by dashed lines 14.

The catch tabs 140 extend inwardly, over the post 14 and thereby support the collar portion 114 on the post. As has been discussed in detail with respect to FIGS. 2 and 2A, the catch tabs 140 preferably extend inwardly a sufficient distance that they extend beyond the walls of the post, thereby engaging the flanges 130 of the cap portion 110 to form a "snap-on", locking engagement.

Figure 3A:
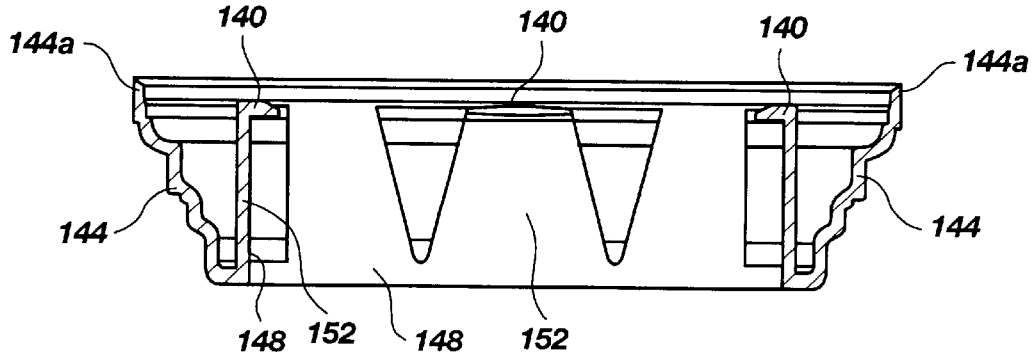
FIG. 3A shows a cross-sectional view of the collar portion of FIG. 3 taken along the line A—A.

FIG. 3A shows a cross-sectional view of the collar portion 114 taken along the line A—A in FIG. 3. The cross-sectional view shows the tapering configuration of the leg 152 as it extends from the inner wall 148 upwardly to the catch tab 140. Such a configuration provides both flexibility and durability to prevent the legs 152 from being easily damaged.

Also shown in FIG. 3A is the relationship between the upper end 144*a* of the outer wall 144 and catch tab 140 at the upper end 152*a* of the leg 152. For reasons which are discussed in detail with respect to FIG. 5, the upper end 144*a* of the outer wall 144 extends higher than the leg 152 of the inner wall 148. Preferably, the difference in height is at least as great as the length of the leg 152 and catch tab 140, and most preferably is greater than the combined height of the leg and catch tab.

Figure 4:
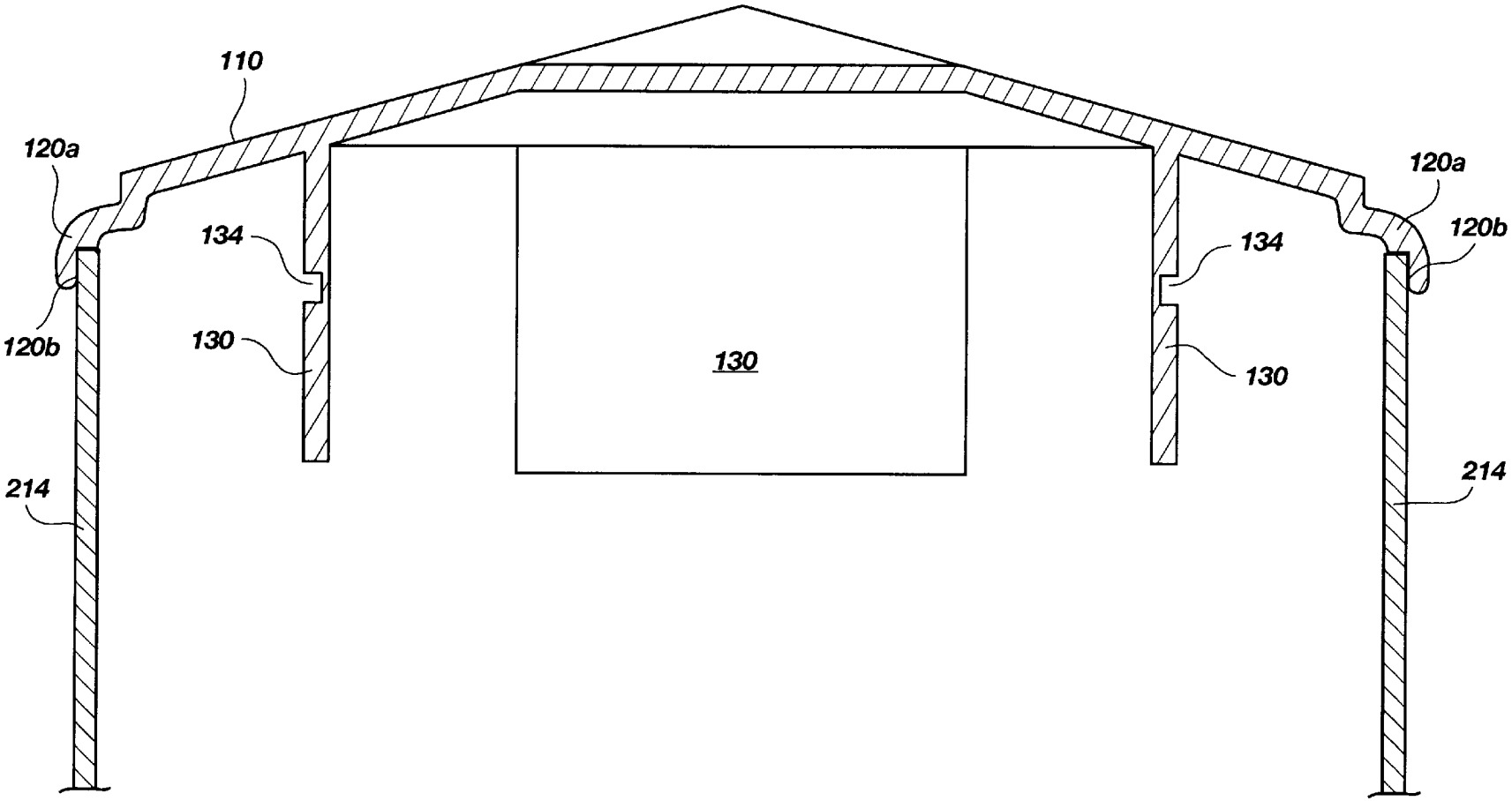
FIG. 4 shows an alternate use of the cap portion independent of the collar portion.

Turning now to FIG. 4, there is shown a cross-sectional view of yet another use of the cap portion 110 of the cover 100. In addition to be configured for use with the collar portion 114, the cap portion 110 can also be configured to form the cover for a larger sized post. Thus, as shown in FIG. 4, the groove 120*b* in the perimeter 120*a* of the upper wall 120 which receives the upper end 144*a* (FIG. 2) of the outer wall 144 of the collar portion 114, can also be used to receive a larger post 214. Thus, for example, if the post 14 in FIG. 2 is a three inch by three inch post, the overhang provided by the cover 100 is about 1 inch on each side. Therefore, the upper wall 120 of the cap portion 110 is slightly greater than five inches by five inches. Without the collar portion 114, the cap portion 110 can be nested on top of the larger post 214, and provide a similar top to that provided to the smaller post, thereby providing a more uniform appearance, even though a collar portion is not used.

Figure 5:
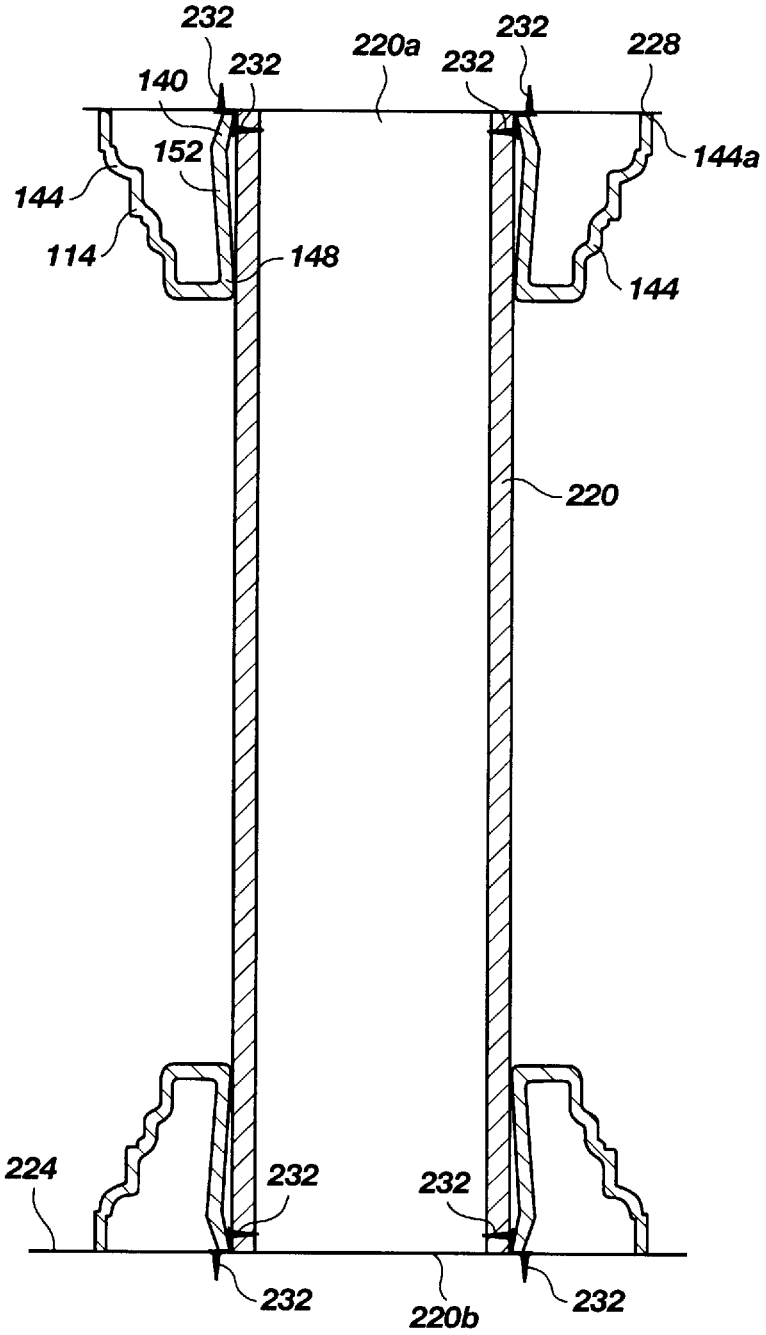
FIG. 5 shows an alternate use of the collar portion independent of the cap portion in accordance with the teachings of the present invention.

Turning now to FIG. 5, there is shown a cross-sectional view of yet another aspect of the invention. A support post 220 is disposed vertically so as to extend from a deck 224 on the bottom to the underside of a roof 228 on the top. Those familiar with vinyl building materials will recognize that such posts are becoming increasingly popular due to their durability and the fact that minimal maintenance is required to keep the post 220 locking nice.

One problem with such posts is that anchor bolts or screws 232 are often used to attach the post to the deck 224 or the roof 228. Often, the bolts or screws and accompanying brackets interfere with the aesthetics of the post 220. Such problems, however, can be overcome by the use of the collar portion 114 of the cover 100 described with respect to FIGS. 2 and 2A.

While the sloped outer wall 144 of the collar portion 114 provides a nice design for the cover 100, it also can be used to conceal the screws 232 or other attachment devices used to secure the post 220. Specifically, the outer wall 144 generally slopes outwardly a sufficient distance to cover the attachment devices, while the leg 152 and the catch tab 140 hold the collar portion in place. As shown in FIG. 5, the collar portion 114 can be used on both the top and bottom ends 220*a* and 220*b*, respectively, of the post, thereby providing an aesthetically pleasing column look.

In use the end of the post 220 is pushed through the void 160 (FIG. 3) formed by the inner wall 148 of the collar portion 114. Because the legs 152 and the catch tabs 140 are somewhat flexible, a moderate amount of force will push the end of the post 220 through the void 160 and past the catch tabs 140. Because the catch tabs 140 and the trim catches 152 are displaced from their normal position, they apply a compressive force against the post 220 and thereby resist movement of the collar portion 114 along the post.

Once on the post 220, the collar portion 114 is pushed a sufficient distance toward the center that the post can be attached in the desired manner. After the post has been attached, force is applied to the collar portion 114 to move the collar portion toward the end of the post. Because the combined height of the trim catch 152 and the catch tab 140 is less than that of the upper end 144*a* of the outer wall 144, the outer wall 144 engages the roof, deck, etc., and avoids the appearance of gaps. In such a position, the collar portion 114 provides a post 220 with no visible signs of attachment to the deck, roof, etc., and without any screws for attaching the collar portion to the post.

The collar portion 114 remains held in place because the legs 152 and the catch tabs 140 continue to be displaced from their normal position and continue to apply a compressive force. If the post 220 is damaged or must be removed for some other reason, the collar portion 114 must merely be slid toward the center of the post to provide access to the attachment mechanism. Once the post 220 has been repaired, replaced, etc., the collar portion 114 is slid to the end of the post 220 and again conceals the attachment devices.

In such a manner, the use of these inexpensive, easily fabricated devices can provide a post with no visible means of attachment, and without the expense or difficulty of attempting to cover attachment marks with fillers and paint. Additionally, if the post ever needs to be removed, this can be accomplished with much less damage to the post, as the person removing the post need not search for the attachment devices.

Thus there is disclosed an improved decorative cover for posts and the like. Those skilled in the art will appreciate numerous modifications which can be made without departing from the scope and spirit of the present invention. For example, in light of the present disclosure, one skilled in the art will appreciate that the respective advantages of the present invention described herein can be achieved by reversing the respective orientations of the flanges, the legs and the catch tabs, such that the catch tabs are formed as part of the cap portion rather than the collar portion. Other modifications will also be readily apparent. The appended claims are intended to cover such modifications.

What is claimed is:

1. A decorative cover configured for covering an upper end of a post, the decorative cover comprising:

collar means for placement on the upper end of a post, said collar means including:

an outer wall configured to circumscribe the upper end of the post when the collar means is placed thereon, the outerwall having a lower edge;

a plurality of partially spaced apart, resilient legs connected to the lower edge of the outer wall and projecting upwardly to terminate interior of the outer wall; and inwardly projecting catch tabs formed adjacent the termination of the legs configured for resting on the upper end of the post when the collar means is disposed thereon; and cap means for placement on the collar means to cover the upper end of the post, said collar means including an upper wall extending outwardly sufficiently to cover the upper end of the post, and a plurality of flanges, each extending downwardly to a position inward of the legs.

2. The decorative cover of claim 1, wherein the upwardly extending legs have an upper end, and wherein the catch tabs extend inwardly and downwardly from the upper end of the legs.

3. The decorative cover of claim 1, wherein the collar means includes an inner wall attached to the lower edge of the outer wall for connecting the plurality of legs to the outer wall.

4. The decorative cover of claim 3, wherein the outer wall extends upwardly and outwardly and wherein the inner wall is generally vertical.

5. The decorative cover of claim 4, wherein the outer wall has a plurality of grooves formed therein.

6. A decorative cover configured for covering an upper end of a post, the decorative cover comprising:

collar means for placement on the upper end of a post, said collar means including:

an outer wall configured to circumscribe the upper end of the post when the collar means is placed thereon, the outer wall having a lower edge;

a plurality of partially spaced apart, resilient legs connected to the lower edge of the lower edge of the outer wall and projecting upwardly to terminate interior of the outer wall; and inwardly projecting catch tabs formed adjacent the termination of the legs and such that the catch tabs rest on the upper end of the post when the collar means is disposed thereon; and cap means for placement on the collar means to cover the upper end of the post, said collar means including an upper wall extending outwardly sufficiently to cover the upper end of the post, and a plurality of flanges extending downwardly for nesting in the upper end of the post; and wherein at least one of the flanges has a channel formed therein for engaging the catch tabs of the collar means to thereby hold the cap means to the collar means.

7. The decorative cover of claim 6, wherein the cap means has an perimeter with a groove formed therein, and wherein the outer wall has an upper end which nests in the groove when the at least one of the catch tabs engages the channel.

8. A decorative cover, post combination comprising:

a post having an upper end;

a collar having a void configured to receiving the post, the collar having four sides and including:

an generally continuous outer wall which circumscribes the end of the post, the outer wall extending upwardly and outwardly from a lower edge to an upper edge;

a plurality of legs connected to the outer wall adjacent the lower edge thereof and extending upwardly to terminate inwardly of the outer wall; and inwardly projecting catch tabs formed on the legs such that the catch tabs extend inwardly so as to engage the upper end of the post when the end of the post is disposed in the void and wherein at least one of the plurality of legs is disposed on each side of the collar.

9. The decorative cover of claim 8, wherein the inwardly extending catch tabs are connected to the legs to as to extend inwardly and downwardly into the void.

10. The decorative cover of claim 8, wherein the collar further includes an inner wall for defining the void and for connecting the legs to the outer wall.

11. The decorative cover of claim 10, wherein the outer wall extends upwardly and outwardly, and wherein the inner wall is disposed generally vertically.

12. The decorative cover of claim 8, wherein the outer wall terminates in an upper end, wherein the legs terminate in an upper end, and wherein the upper end of the outer wall extends beyond the upper end of the legs.

13. The decorative cover of claim 12, wherein the catch tabs are attached to the upper ends of the legs, and wherein the upper end of the outer wall extends beyond a combined length of a leg and a catch tab.

14. The decorative cover of claim 8, further comprising:

cap means for attachment to the collar to cover the upper end of the post, said cap means including an upper wall extending outwardly sufficiently to cover the upper end of the post, and a plurality flanges extending downwardly for nesting in the upper end of the post.

15. The decorative cover of claim 14, wherein the flanges are configured for engaging the catch tabs of the collar to thereby hold the cap portion to the collar.

16. A method for concealing attachment devices used to connect an end of a post to a structure, the method comprising:

(a) selecting a decorative collar having a void configured therein to receiving the post, the collar including (i) generally continuous outer wall which circumscribes the end of the post and extending upwardly and outwardly from a lower edge to an upper edge; (ii) a plurality of legs connected to the lower edge of the outer wall and extending upwardly from the lower edge to terminate inwardly of the outer wall; and (iii) inwardly biased catch tabs formed at the top of the legs such that the catch tabs extend inwardly when a post is not disposed in the void, and which apply a compressive force against the post when the post extends through the void to thereby hold the decorative collar in place on the post; and (b) sliding the decorative collar over the end of the post to conceal the attachment devices and such that the legs and catch tabs hold the decorative collar over the end of the post by application of a compressive force.

17. A decorative cover for covering an upper end of a post, the decorative cover comprising:

a collar having a void configured to receiving a post, the collar including:

an generally continuous outer wall which circumscribes the end of the post when a post is disposed in the void, the outer wall extending upwardly and outwardly from a lower edge to an upper edge;

a plurality of legs connected to the outer wall adjacent the lower edge thereof and extending upwardly to terminate inwardly of the outer wall; and inwardly projecting catch tabs formed on the legs such that the catch tabs extend inwardly so as to engage the upper end of the post when the end of the post is disposed in the void; and cap means for attachment to the collar to cover the upper end of the post, said cap means including an upper wall extending outwardly sufficiently to cover the upper end of the post, and a plurality flanges extending downwardly for nesting in the upper end of the post, the flanges being configured for engaging the catch tabs of the collar to thereby hold the cap portion to the collar.

18. A post and decorative cover combination comprising:

a post having an upper end;

collar means for placement on the upper end of the post, said collar means including:

an outer wall configured to circumscribe the upper end of the post when the collar means is placed thereon, the outer wall having a lower edge;

a plurality of partially spaced apart, resilient legs connected to the lower edge of the lower edge of the outer wall and projecting upwardly to terminate interior of the outer wall; and inwardly projecting catch tabs formed adjacent the termination of the legs and such that the catch tabs rest on the upper end of the post when the collar means is disposed thereon; and cap means for placement on the collar means to cover the upper end of the post, said collar means including an upper wall extending outwardly sufficiently to cover the upper end of the post, and a plurality of flanges extending downwardly for nesting in the upper end of the post.

* * * * *